United States Patent [19]

Eriksson

[11] 4,298,092

[45] Nov. 3, 1981

[54] DEVICE AT UNFOLDABLE ESCAPE-LADDER

[76] Inventor: Lars O. Eriksson, Sigyns väg 5c, 149 00 Nynäshamn, Sweden

[21] Appl. No.: 129,349

[22] Filed: Mar. 11, 1980

[51] Int. Cl.[3] ..... E06C 1/56

[52] U.S. Cl. ..... 182/70; 182/196

[58] Field of Search ..... 182/196, 197, 198, 70, 182/76

[56] References Cited

U.S. PATENT DOCUMENTS

| | | | |
|---|---|---|---|
| 260,245 | 6/1882 | Schmidt | 182/196 |
| 321,385 | 6/1885 | Pyne | 182/196 |
| 1,010,526 | 12/1911 | Stanley | 182/70 |
| 2,202,597 | 5/1940 | Myerstuen | 182/198 |
| 2,735,603 | 2/1956 | Corey | 182/197 |

FOREIGN PATENT DOCUMENTS

| | | | |
|---|---|---|---|
| 1430360 | 1/1966 | France | 182/196 |
| 7609889 | 2/1978 | Sweden | 182/196 |

*Primary Examiner*—Reinaldo P. Machado

*Attorney, Agent, or Firm*—LeBlanc, Nolan, Shur & Nies

[57] ABSTRACT

A device at an unfoldable escape-ladder, which is assembled of rungs (1), the ends (3) of which are attached between flexible lateral members (5), preferably steel wires, which rungs (1) are longish and made of plate-shaped material and can be stacked, the upper portion of the escape-ladder intended to be attached to a wall (6), a stay or the like, which escape ladder in folded state has the rungs (1) lying stacked and forming with each of the steel wires (5) a ring for each rung (1), which escape-ladder is provided with a means for releasing the ladder. According to the invention, two steel wires (4) or rods are provided which are located in parallel and rigidly mounted along the direction, which the ladder in unfolded state is desired to assume, which steel wires (4) or rods extend through the rings formed by the first-mentioned steel wires (5). As a result thereof, the last-mentioned steel wires (4) or rods in unfolded state of the ladder are wound about the first-mentioned steel wires (5) and thereby render the ladder extremely steady.

5 Claims, 7 Drawing Figures

Fig. 6
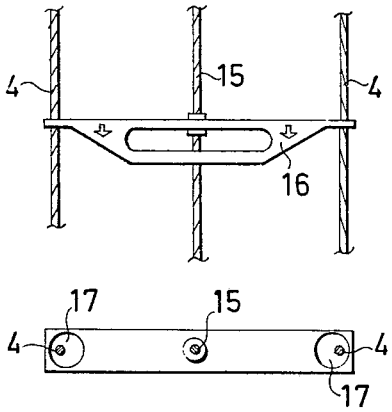
Fig. 7
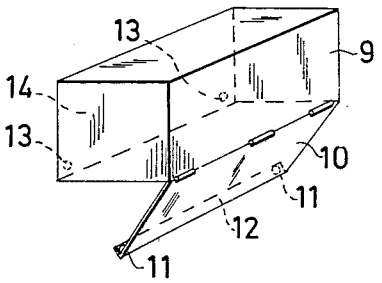
Fig. 5
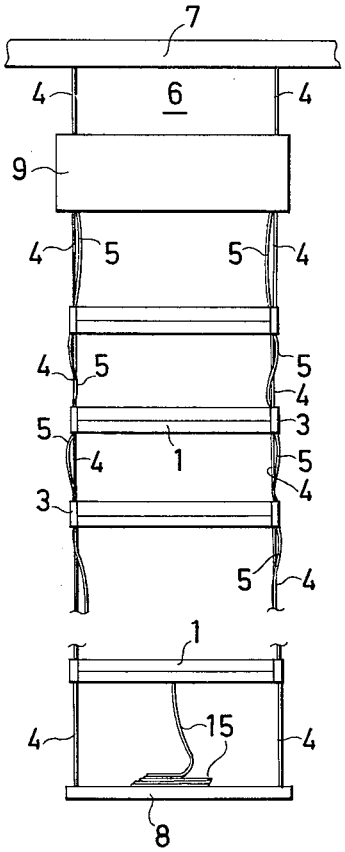
Fig. 4

DEVICE AT UNFOLDABLE ESCAPE-LADDER

This invention relates to a device at an unfoldable escape-ladder, which is assembled of rungs, the ends of which are attached between two flexible lateral members, such as steel wires.

In Swedish No. 7609889-6 an unfoldable escape-ladder is disclosed, at which the rungs are made of longish pieces of plate-shaped material, such as iron sheet metal, which has been bent to W-section. The ends of the rungs are provided with tubes bent to wavy turns and so arranged as to tightly and firmly enclose the flexible lateral members, i.e. the steel wires. The W-section of the rungs is such as to permit stacking of the rungs.

Upon stacking a number of rungs, the steel wires on both sides thereof form a number of rings, which are located to the side of each other and thereby form a tubular body of the steel wire on each side of the rungs.

The escape-ladder according to the above patent is intended to be attached with its upper portion on a building, preferably inside and above a window, and for its utilization to be thrown out whereby the ladder positions itself along the building wall.

A problem has been discovered when the aforesaid ladder had to be used at heights exceeding two storeys, viz. that the ladder with a person climbing down thereon tends to revolve, so that the climbing person's body bumps against the building wall. This problem implies that a certain agility and gymnastic proficiency as well as presence of mind are required for safely managing the down-climbing from great height. For buildings having more than two storeys, including substantially all multi-family houses, hotels, schools etc., the said problem cannot be tolerated, because the risk of injuries especially for elderly people and children is too great.

The present invention solves this problem entirely, so that a ladder of the aforesaid kind can be used for the same heights as rigidly mounted stationary ladders.

The present invention, thus, relates to a device at an unfoldable escape-ladder, which is assembled of rungs, the ends of which are attached between flexible lateral members, preferably steel wires, which rungs are longish and of plate-shaped material and can be stacked side against side, the upper portion of the escape-ladder intended to be attached on a wall, a stay or the like, and the rungs of the escape-ladder in folded state lying stacked and forming with each of the steel wires a ring for each rung, which escape-ladder is provided with a means for releasing the ladder. The device according to the present invention is characterized in that two steel wires or rods are located in parallel and rigidly mounted along the direction desired to be assumed by the ladder in unfolded state, which steel wires or rods extend through the rings formed by the firstmentioned steel wires.

Figure 1:
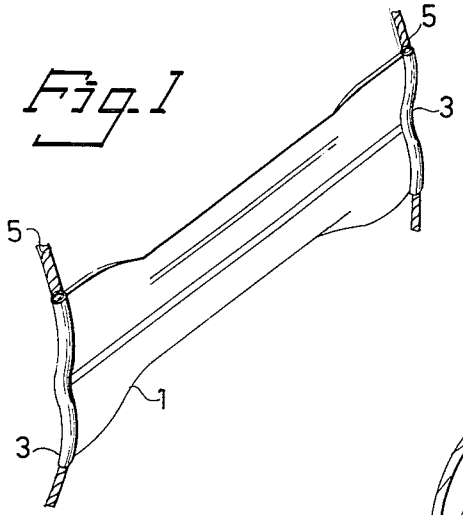
Figure 2:
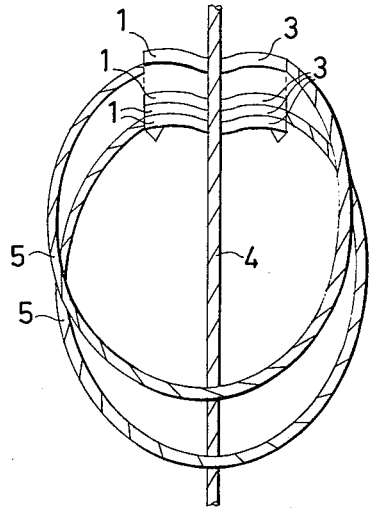
Figure 3:
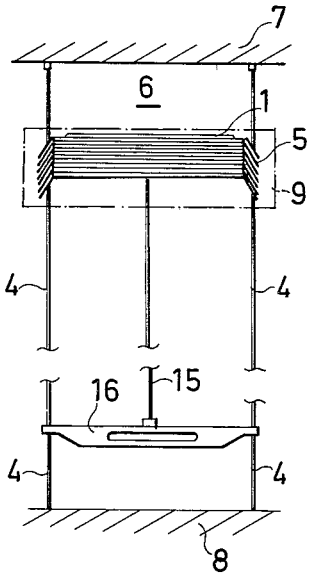

The invention is described in greater detail in the following, with reference to the accompanying drawing, in which FIG. 1 is a perspective view of a rung, FIG. 2 is an end view of an escape-ladder comprising a number of stacked rungs and rings formed of steel wires, FIG. 3 is a front view of an escape-ladder in folded state, to which the present invention is applied, FIG. 4 is a front view of an unfolded escape-ladder, to which the present invention is applied, FIG. 5 shows a housing for a folded ladder, FIGS. 6 and 7 are a front view and, respectively, a view from above of a handle.

In FIG. 1 a rung 1 made of longish pieces of iron sheet metal with W-shaped cross-section is shown. The rungs 1 are attached suitably spaced between two flexible lateral members, such as steel wires 5, in that the end edges 3 of the rungs are bent about each wire 5, so that a wavy tube is formed about each wire 5.

The rungs can be stacked side against side, as shown in FIG. 2. In folded state, as shown in FIGS. 2 and 3, the rungs 1 are lying stacked and form with each of the steel wires 5 a ring for every rung 1. The escape-ladder is attached at its upper portion to a wall 6 or the like, preferably in that the uppermost rungs are screwn on the wall.

According to the present invention, two steel wires or rods 4 are provided, which are located in parallel and rigidly mounted along the direction, which the ladder in unfolded state is desired to assume. In FIGS. 3 and 4 said direction is chosen to be vertical between the lower surface of a roof or a stay 8 and the ground or a stay 8. The steel wires or rods 4 extend through the rings formed by the firstmentioned steel wires 5, see FIG. 2.

In folded state, the ladder is enclosed by a housing 9, the bottom 10 of which is hinged to be opened and provided with a spring catch or the like, for example, in FIG. 5, protuberances 11 on the lateral piece 12 of the bottom 10 and corresponding indentations 13 in one of the lateral pieces 14 of the housing 9.

The said catch is arranged so that a certain force must be applied to the bottom for opening the same, and that said force exceeds the force exerted by the folded ladder on the bottom.

In folded state, namely, said rings act as springs tending to unfold the ladder. Owing to this effect, the release of the ladder by spring action is followed by a rapid and efficient unfolding of the ladder in its entire length.

Upon release, the firstmentioned steel wires 5 are wound about the vertical steel wires or rods 4, as indicated in FIG. 4, because the vertical steel wires or rods 4 in folded state of the ladder extend through the rings formed by the steel wires 5. The unfolded ladder, thus, is extremely steady. Its steadiness is fully comparable with that of a rigidly mounted stationary ladder, and the ladder according to the present invention, therefore, can be used for the same heights as rigidly mounted ladders.

According to a preferred embodiment of the invention, a special release means is provided, which comprises a wire 15, for example a steel wire, which is attached to the ladder, preferably to the lowermost rung 1 and in folded state of the ladder extends past one or several places, such as windows, where the ladder is desired to be released. For releasing the ladder, the wire 15 is to be pulled, which causes the lowermost rung 1 to be drawn out of the housing 10 whereafter the ladder rapidly expands to its full length.

The wire 15 preferably is attached to a handle 16 at each place of release. The handle 16 has holes 17, through which said steel wires or rods 4 extend. The release handle 16, therefore, always has a predetermined position. Only one handle 16 is shown in FIG. 3.

The wire 15 has such a length that its lower end in folded state of the ladder terminates about 3 meters above the ground, in order to prevent release of the ladder by mischief from ground level. In FIGS. 3 and 4 the steel wires 4,5 are shown cut-off in order to shorten the height of the Figures.

A ladder of the kind referred to in the above introductory portion, to which the present invention is applied, thus, shows the advantages of being a steady ladder, and that the ladder easily can be released from different places along the desired direction of the ladder.

The invention must not be regarded restricted to the embodiments described above, but can be varied with respect to material choice and detail design without abandoning the invention idea. The invention, thus, can be varied within the scope defined in the attached claims.

I claim:

1. A device comprising an unfoldable escape-ladder, which is assembled of rungs (1), the ends (3) of which are attached between flexible lateral members (5), preferably steel wires, which rungs (1) are longish and made of plate-shaped material and can be stacked side against side, and the upper portion of the escape-ladder is intended to be attached to a wall (6), a stay or (1) lying stacked and forming with each of the steel wires (5) a ring for each rung, and which escape-ladder is provided with a means for releasing the ladder, characterized in that two steel wires (4) or rods are provided, which are located in parallel and rigidly attached along the direction, which the ladder in unfolded state is desired to assume, and that said steel wires (4) or rods extend through the rings formed by the firstmentioned steel wires (5).

2. A device as defined in claim 1, characterized in that said release means comprises a wire (15), such as a steel wire, which is attached to the ladder, preferably to the lowermost rung (1), and extends past one or several places, such as windows, where the ladder is desired to be released.

3. A device as defined in claim 2, characterized in that said wire (15) is attached to a handle (16) at each release place, which handle (16) is provided with holes (17), through which said steel wires (4) or rods extend.

4. A device as defined in claim 2, characterized in that said wire (15) has such a length, that its lower end is intended to terminate about 3 meters above the ground.

5. A device as defined in claim 1, characterized in that the ladder in folded state is enclosed by a housing (9), the bottom (10) of which can be opened where the bottom (10) is provided with a spring catch or the like (11,13), which implies that a certain force must be applied to the bottom (10) to cause it to open, which catch (11,13) is so arranged that said force exceeds the force exerted by a folded ladder on the bottom (10).

* * * * *

UNITED STATES PATENT AND TRADEMARK OFFICE

CERTIFICATE OF CORRECTION

PATENT NO. : 4,298,092

DATED : November 3, 1981

INVENTOR(S) : Lars O. Eriksson

It is certified that error appears in the above-identified patent and that said Letters Patent are hereby corrected as shown below:

Column 3, line 22, after "a stay or" insert --the like, which escape-ladder in folded state has its rungs--.

Signed and Sealed this

Sixteenth Day of March 1982

[SEAL]

Attest:

GERALD J. MOSSINGHOFF

Attesting Officer

Commissioner of Patents and Trademarks